United States Patent [19]

Yoshioka et al.

[11] Patent Number: 4,469,428

[45] Date of Patent: Sep. 4, 1984

[54] CORONA DISCHARGING APPARATUS USED IN AN ELECTROSTATIC PHOTOGRAPHIC COPYING MACHINE

[75] Inventors: Masahiro Yoshioka; Masahiro Murakami, both of Osaka; Eiji Tsutsui, Amagasaki; Noriyuki Iwao, Kobe, all of Japan

[73] Assignee: Mita Industrial Co., Ltd., Osaka, Japan

[21] Appl. No.: 402,329

[22] Filed: Jul. 27, 1982

[30] Foreign Application Priority Data

Aug. 8, 1981 [JP] Japan ..... 56-118484[U]
Aug. 8, 1981 [JP] Japan ..... 56-118485[U]

[51] Int. Cl.[3] ..... G03G 15/00

[52] U.S. Cl. ..... 355/3 CH; 355/14 CH; 355/3 TR; 355/14 TR; 250/325

[58] Field of Search ..... 355/3 CH, 14 CH, 3 R; 250/324, 325, 326; 430/937; 361/212, 213, 225, 426; 118/620

[56] References Cited

U.S. PATENT DOCUMENTS 3,374,348 3/1968 Ostensen ..... 355/3 CH X
3,578,970 5/1971 Michaud et al. ..... 250/325
3,609,354 9/1971 Herman ..... 355/3 CH X
3,764,804 10/1973 Hirschman .
3,936,635 2/1976 Clark ..... 250/325
4,089,600 5/1978 Ito et al. ..... 355/3 CH
4,099,219 7/1978 Laing .
4,110,811 8/1978 Hubble et al. ..... 361/426
4,174,170 11/1979 Yamamoto et al. .
4,252,431 2/1981 Cormier ..... 355/3 CH
4,260,240 4/1981 Pieper ..... 250/325 X
4,320,957 3/1982 Brown et al. ..... 355/3 CH

FOREIGN PATENT DOCUMENTS 1216089 12/1970 United Kingdom .

*Primary Examiner*—A. C. Prescott
*Attorney, Agent, or Firm*—Wenderoth, Lind & Ponack

[57] ABSTRACT

A corona discharging apparatus used in an electrostatic photographic copying machine includes a shield case provided with an open portion facing a circumferential surface of a sensitive drum. The shield case is detachably and dislocatably provided with a shield cover for regulating an electrifying width achieved by a thin wire for corona discharging arranged in the shield case at a longitudinal end of the shield case over the open portion.

13 Claims, 13 Drawing Figures

CORONA DISCHARGING APPARATUS USED IN AN ELECTROSTATIC PHOTOGRAPHIC COPYING MACHINE

BACKGROUND OF THE INVENTION

1. Field of the Invention

The present invention relates to an improvement of a corona discharging apparatus used in a charging apparatus or a transfer apparatus or a cleaning apparatus of an electrostatic photographic copying machine.

2. Description of the Prior Art

It is necessary to strictly set particularly the length of a thin wire used for corona discharging (that is to say, the electrifying width achieved by such thin wire) in a corona discharging apparatus. Thus, if the thin wire is too short (for example having a length equal to the width of the copying paper), both ends of the wire receive less than sufficient electric current, and thereby indistinct copying is achieved by both ends of the wire since the quantity of charging at the central part of the corona discharging apparatus inevitably is different from the opposite ends thereof. On the contrary, an excessively long thin wire leads to corona discharge even at parts at both ends not intended for copying, and as a result the toner is spattered over parts of the electrostatic photographic copying machine. The adherence of such spattered toner on, for example, the shield case of the corona discharging apparatus leads to various disadvantages such as a decrease in the effect of the electric discharge or the development of an abnormal electric discharge.

As described above, it is very important to set the length of thin wire, and thus such setting has been done at the stage of design and manufacture of the machine and thereby must be achieved very precisely. If the length of the thin wire is found to be unsuitable after assembling the fabricated corona dicharging apparatus on an electrostatic photographic copying machine, the design and manufacture of the length of the thin wire again must be carried out. This requires extra time and cost.

SUMMARY OF THE INVENTION

It is an object of the present invention to eliminate the above described disadvantages incidental to the conventional apparatus.

A corona discharging apparatus used in an electrostatic photographic copying machine according to the present invention comprises a shield case provided with an open portion facing the circumferential surface of a sensitive drum and mounted on a fixed wall of the electrostatic photographic copying machine to extend substantially parallel to the longitudinal direction of the sensitive drum. At least one thin wire for corona discharging is longitudinally arranged in the shield case. A shield cover is provided for regulating the electrifying width achieved by the thin wire. The shield cover is detachably and dislocatably mounted on a longitudinal end of the shield case over the portion thereof.

According to the above described structure of the corona discharging apparatus of the present invention, it is necessary only to regulate the position of the shield cover in order to regulate very easily the electrifying width achieved by the thin wire. Consequently, it is not required to strictly set the length of the thin wire at the stage of design and manufacture, and thereby the design and manufacture can be carried out easily and inexpensively.

Furthermore, the length of the thin wire can be easily regulated after assembly. Consequently, an individual corona discharging apparatus can achieve a required electrifying width strictly corresponding to the performance thereof, and thus the spatter of toner due to an unsuitable electrifying width incidental to the conventional apparatus can be prevented. Thereby, staining due to toner splatter, reduction of the electric discharge effect, development of abnormal electric discharge and the like can be prevented.

In addition, it is necessary only to remove the shield cover in order to easily clean the end portions of the shield case, which end portions particularly are liable to be stained, and easily repair the thin wire if it has been broken, since the shield cover is detachably mounted.

When applying a corona discharging apparatus according to the present invention to a transfer apparatus of an electrostatic photographic copying machine of the type in which a separation nail is mounted on one longitudinal side of the sensitive substances, there is the advantage that copying papers are not stained since the transfer of the parts on which the separation nail passes can be cut.

DESCRIPTION OF THE PREFERRED EMBODIMENTS

Figure 1:
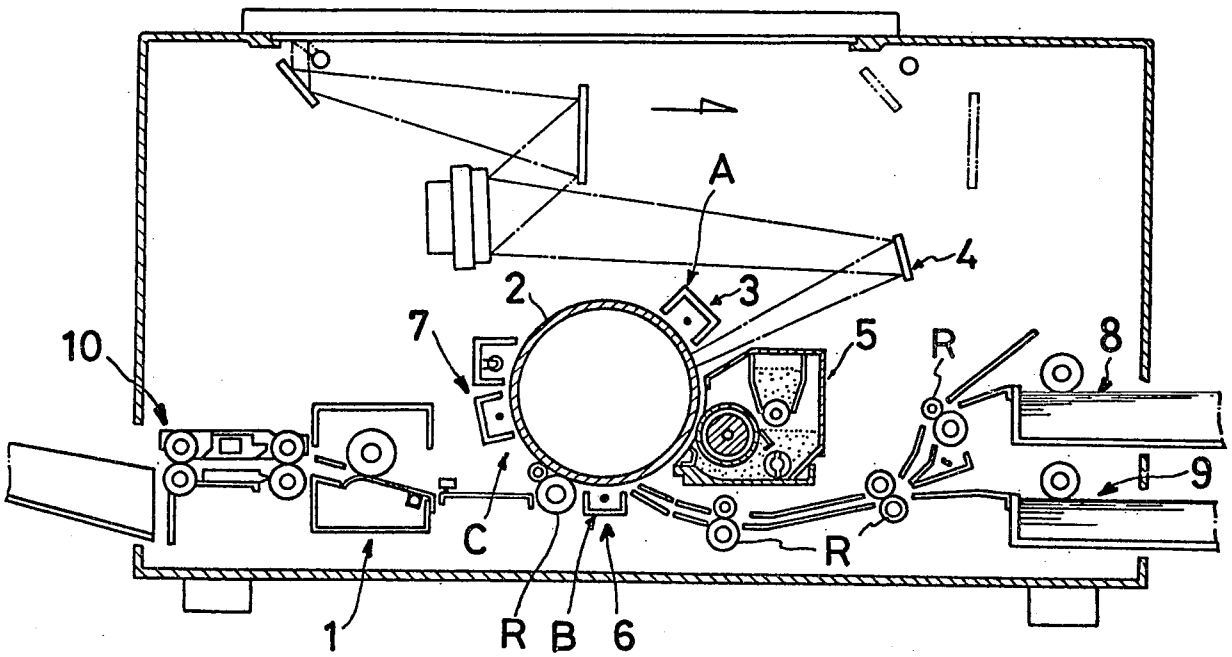
FIG. 1 is the general schematic view showing an electrostatic photographic copying machine.

Referring now to FIG. 1 which is a general schematic view showing an electrostatic photographic copying machine with which may be employed a corona discharging apparatus according to the present invention, a charging apparatus 3, an exposure apparatus 4, a developing apparatus 5, a transfer apparatus 6 and a cleaning apparatus 7 are arranged along the outer circumferential surface of a rotary photo sensitive drum 2. Paper transfer rollers R transfer copying papers from paper-supplying apparatus 10 via transfer apparatus 6.

Charging apparatus 3, transfer apparatus 6 and cleaning apparatus 7 each is composed of a corona discharging apparatus A, B, C. That is to say, charging apparatus 3 is provided with corona discharging apparatus A, transfer apparatus 6 is provided with corona discharging apparatus B, and cleaning apparatus 7 is provided with corona discharging apparatus C, all of which are mounted on a fixed wall (not shown in FIG. 1) inside the electrostatic photographic copying machine.

The structure only of corona discharging apparatus A will be described hereinafter, since corona discharging apparatus A, B, C all have the same structure fundamentally.

Figure 2:
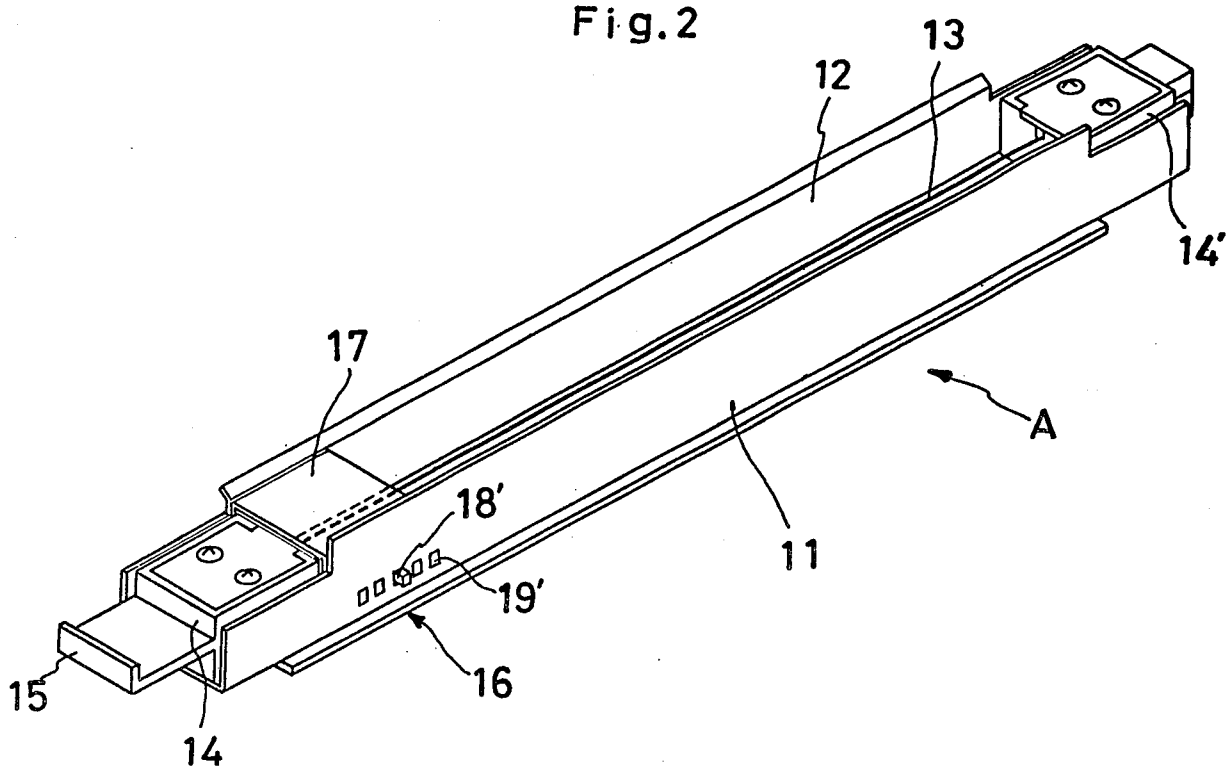
FIG. 2 is a perspective view showing the corona discharging apparatus.
Figure 3:
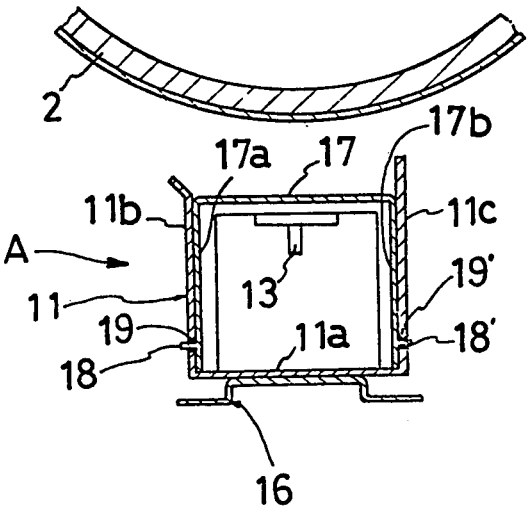
FIG. 3 is a sectional view of the corona discharging apparatus shown in FIG. 2.
Figure 4:
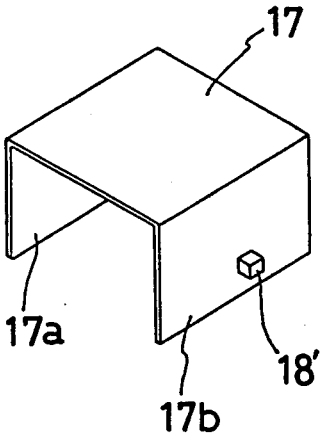
FIG. 4 is a perspective view showing a shield cover.

Referring now to FIGS. 2, 3, a shield case 11 is provided with an open side or portion 12 facing toward drum 2, with a thin wire 13 therein for corona discharging. A pair of bases 14, 14' stretch thin wire 13. A handle 15 is integrally formed to project from one side of one of the bases 14. A rail member 16 (described in more detail below) is fixedly mounted on the underside of a bottom plate 11*a* of shield case 11. A shield cover 17, made of an insulating material having elasticity, such as polycarbonate, Duranex (trade name) manufactured and sold by Polyplastics Co., Ltd., Osaka, Japan and the like, is formed to have a U-shape in longitudinal section, as shown in FIGS. 3 and 4. Left side plate 17*a* and right side plate 17*b* of shield cover 17 are provided with respective projections 18, 18' extending outwardly. Shield cover 17 is detachably and dislocatably mounted on one longitudinal end of shield case 11 over open portion 12 by fitting projections 18, 18' in any one of a plurality of holes 19 . . . , 19' . . . formed in left side wall 11*b* and right side wall 11*c* of shield case 11, as shown in FIG. 2. The electrifying or discharging width achieved by means of thin wire 13 may be regulated as desired by means of shield cover 17.

Figure 5:
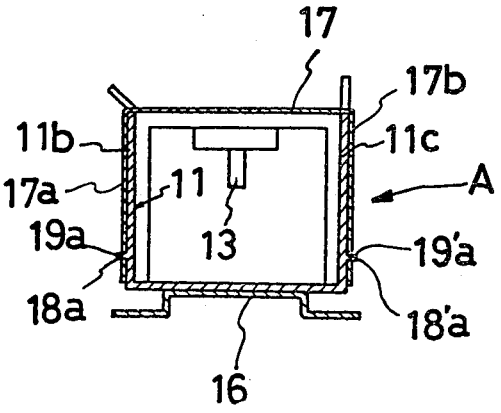
FIGS. 5, 6 are sectional views showing different preferred embodiments of the present invention, FIGS. 7, 8 respectively are a perspective view and a sectional view showing a further different preferred embodiment of the present invention.
Figure 6:
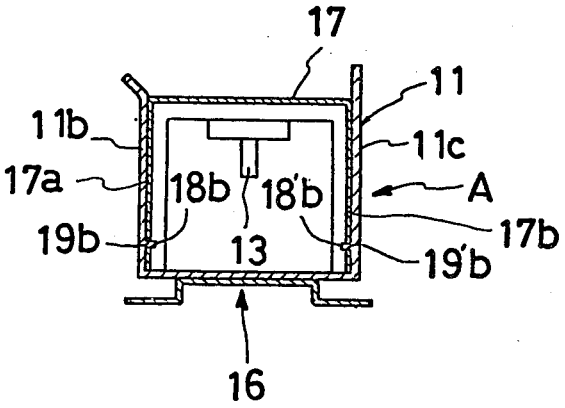

Referring now to FIGS. 5, 6 showing second and third preferred embodiments of the present invention, shield case 11 is provided with projections 18*a*, 18'*a* or 18*b*, 18'*b* on the outside or the inside of left side wall 11*b* and right side wall 11*c* thereof, and shield cover 17 formed in a U-shaped in longitudinal section is provided with a plurality of holes 19*a* . . . , 19'*a* . . . or 19*b* . . . , 19'*b* . . . in the side walls 17*a*, 17*b* thereof, thereby to detachably and dislocatably mount shield cover 17 on one longitudinal end of shield case 11 over open portion 12.

Figure 7:
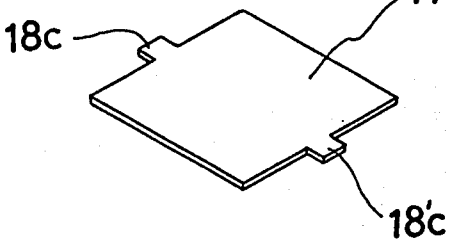
Figure 8:
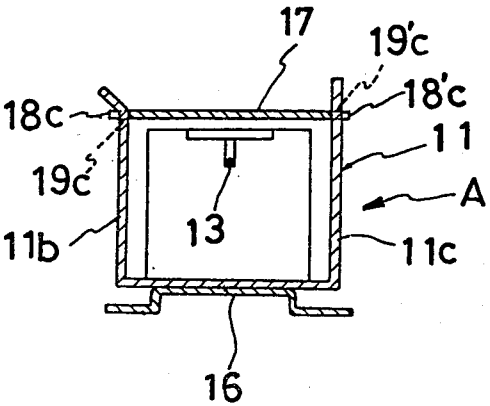

Referring now to FIGS. 7, 8 showing a fourth preferred embodiment of the present invention, shield cover 17 is shaped in the form of a flat plate. Projections 18*c*, 18'*c* formed on opposite sides of shield cover 17 engage with selected holes of a plurality of holes 19*c* . . . , 19'*c* . . . (formed in the longitudinal direction of shield case 11 similarly to the above described preferred embodiment of the present invention) formed in the upper part of the left side wall 11*b* and the right side wall 11*c* of shield case 11.

Figure 9:
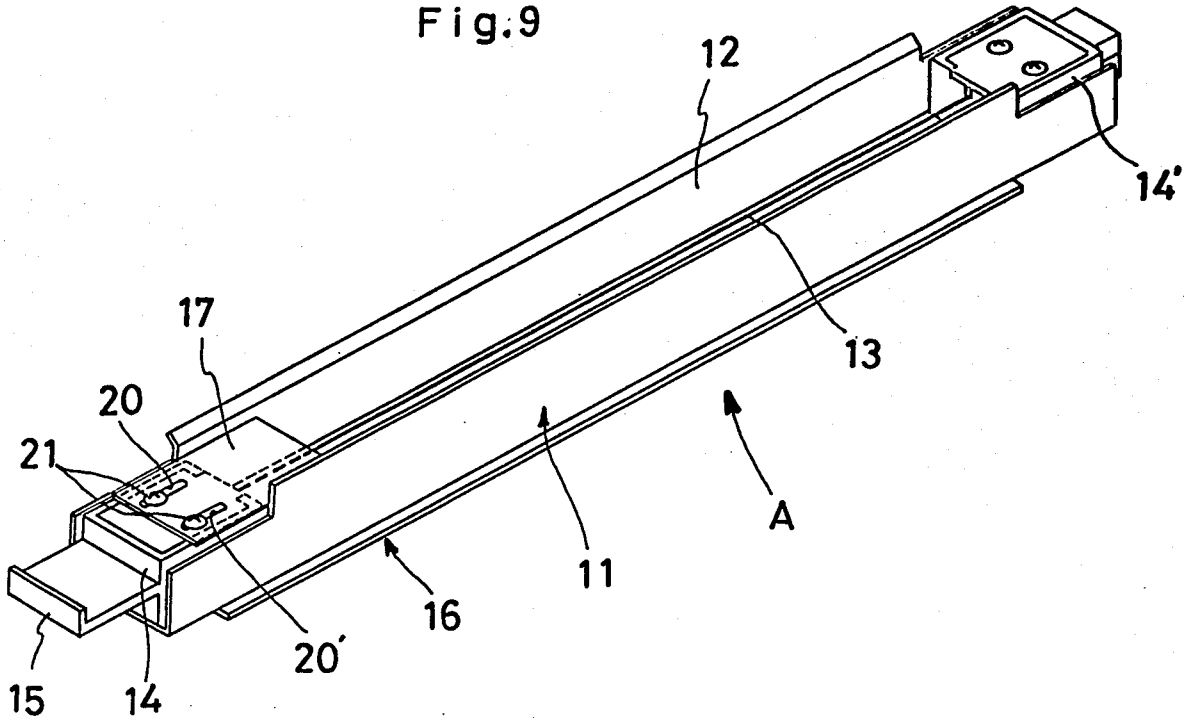
FIG. 9 is a perspective view showing a still further different preferred embodiment of the present invention.

Referring now to FIG. 9 showing a fifth preferred embodiment of the present invention, a shield cover 17 shaped in the form of a flat plate is provided with a pair of elongated holes 20, 20', though alternatively a plurality of pairs of round holes may be employed. Shield cover 17 is detachably and dislocatably mounted on one longitudinal end of shield case 11 over open portion 12 by means of screws 21, made of an insulating material such as polyethylene and the like, extending through elongated holes 20, 21' and threaded into tapped holes (not shown) formed in base 14.

Only the structure for fitting corona discharging apparatus A of charging apparatus 3 on the fixed wall inside the electrostatic photographic copying machine will be described in detail, since the structure for fitting all of apparatus A, B, C on the fixed wall fundamentally are the same.

Figure 10:
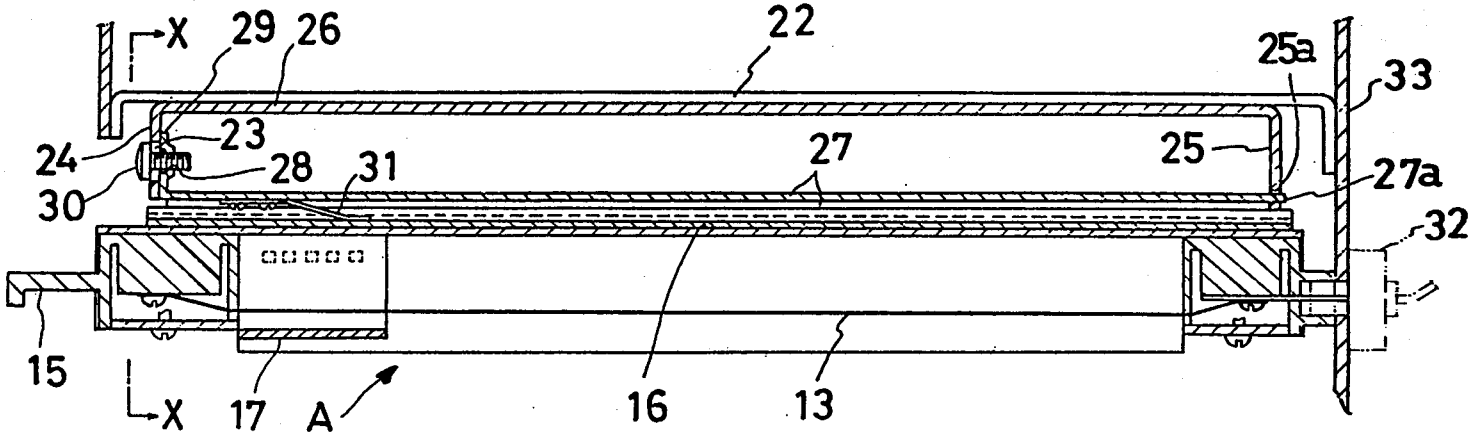
FIG. 10 is a sectional view showing a fitting structure of a corona discharging apparatus.
Figure 11:
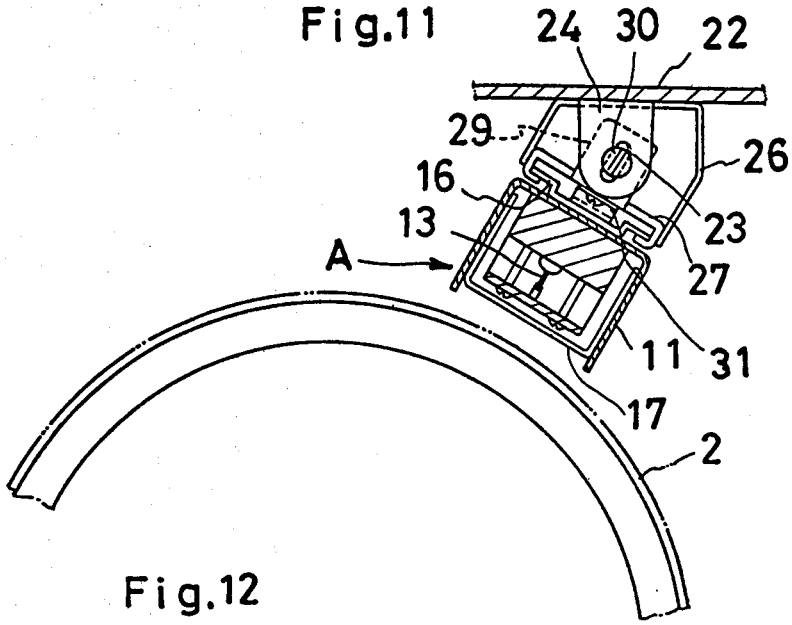
FIG. 11 is a sectional view through FIG. 10 taken along the line X—X thereof.
Figure 12:
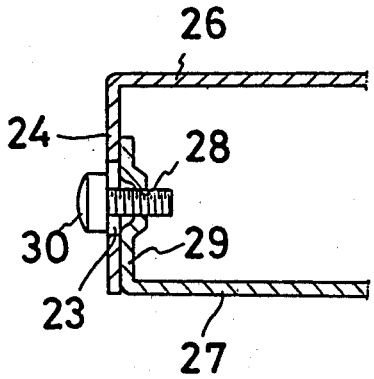
FIG. 12 is an enlarged view showing a part of a fitting structure of a corona discharging apparatus as shown in FIG. 10.

Referring now to FIGS. 10, 11, 12, a wall 22 is fixedly formed inside the electrostatic photographic copying machine. Fixed wall 22 is provided with a supporting member including a channel member 26 having at one longitudinal end thereof a bracket 24 having an elongated hole 23 extending toward the rotary axis of drum 2 and having at the other end thereof a bracket 25. Channel member 26 is provided, in an open portion thereof facing drum 2, with a rail-receiving member 27 which is provided at one end thereof with a bracket 29 abutting bracket 24 and having a tapped hole 28. Bracket 29 is fixedly mounted on bracket 24 by means of a screw 30 passing through elongated hole 23 and tapped hole 28. A projection 27*a* at the opposite end of rail-receiving member 27 is inserted in a hole 25*a* formed in bracket 25 and thereby is supported. Thus, one end of rail-receiving member 27 is dislocatable in the radial direction of drum 2, with hole 25*a* of bracket 25 being a supporting point, and can be fixed at an optional position within the allowable range of hole 23 by means of screw 30.

On the other hand, corona discharging apparatus A is provided with rail member 16 of a configuration complementary to rail-receiving member 27 and is mounted on fixed wall 22 by means of rail-receiving member 27, channel member 26, and the like. Thus, corona discharging apparatus A is longitudinally slidable and dislocatable relative to the circumferential surface of drum 2, and is movable radially thereof by changing the relative relationship between the positions of brackets 24, 29 by the operation of screw 30.

Furthermore, a plate spring 31 is arranged between rail member 16 and rail-receiving member 27 and ensures that rail member 16 and rail-receiving member 27 are urged toward each other in friction contact. Longitudinally sliding of corona discharging apparatus A may be achieved manually by the use of handle 15. A power-supplying connector 32 for corona discharging apparatus A is fixedly mounted on a fixed wall 33 inside the electrostatic photographic copying machine.

An end of rail-receiving member 27 may be pivoted on channel member 26 by means of a pin or the like, rather than fixedly mounted on channel member 26 by means of bracket 25. Further, such end of rail-receiving member 27 may be dislocatably mounted so as to be movable in the radial direction of drum 2 in the same manner as the other end of rail-receiving member 27.

Figure 13:
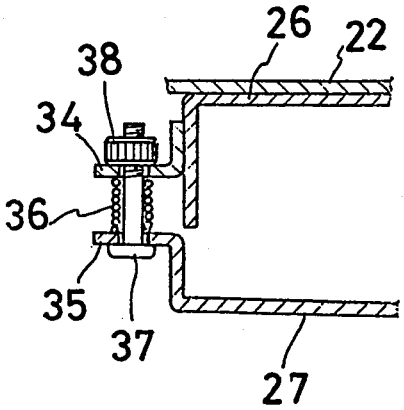
FIG. 13 is a sectional view showing a further different preferred embodiment of the present invention.

Referring now to FIG. 13 showing a further different preferred embodiment of the present invention in which the dislocating mechanism shown in FIG. 12 is modified, a flange 34 is mounted on channel member 26, and a flange 35 is mounted on rail-receiving member 27, and thereby the position of corona discharging apparatus A can be regulated by connecting flange 34 with flange 35 by means of a spring 36, a bolt 37 and a nut 38.

On the contrary, according to a prior art arrangement, for example as disclosed in Japanese Utility Model Laid-Open No. 120441/1975, a shield case 11 is mounted on a fixed wall inside an electrostatic photographic copying machine so that it can be longitudinally dislocatable, but it cannot be transferred in the radial direction of drum 2. As a result, thin wire 13 for corona discharging must be provided with a pressing member at one end thereof inside shield case 11 in order to prevent uneven exposure in the longitudinal direction of drum 2. Accordingly, it is necessary to provide structure whereby the distance between one end of thin wire 13 and drum 2 is changed by regulating such pressing member. This structure results in a delicate and complicated construction of the apparatus, and thereby the regulating operation for preventing uneven exposure is remarkably difficult. In addition, there is the disadvantage that the positional relationship of thin wire 13 relative to shield case 11 is changed, and at the same time the amount of electric current passing through thin wire 13 is changed since the tensile characteristic of said thin wire 13 is changed. As a result, the corona discharging apparatus is unevenly electrified, thereby making it still more difficult to prevent uneven exposure of drum 2.

On the contrary, according to the present invention, as described above, shield case 11 of corona discharging apparatus A is mounted on the fixed wall at at least one longitudinal end thereof so that it can be dislocatable relative to drum 2, rather than attempting to change the position of thin wire 13 itself relative to the circumferential surface of drum 2. Thereby, the position of shield case 11, that is to say of corona discharging apparatus A as a whole, can be regulated relative to the circumferential surface of drum 2. Thus, there is not the disadvantage incidental to the conventional apparatus that uneven electrification occurs when attempting to prevent uneven exposure. In addition, the operating mechanism for regulating the position of shield case 11 can be simplified in construction and easily operated, contrary to the conventional apparatus, since it is not necessary to place such operating mechanism for regulating the position of shield case 11 in a narrow space inside shield case 11. That is to say, the operation for preventing uneven exposure easily can be achieved even though the construction is simple as a whole.

Furthermore, the provision of screw 30 or nut 38 on the end portion of channel member 26, as shown in each of the above described preferred embodiments, leads to the possibility of regulating easily the position of shield case 11 relative to the circumferential surface of drum 2 from the outside without removing shield case 11.

What is claimed is:

1. A corona discharging apparatus for use in an electrostatic photographic copying machine, said apparatus comprising:

an elongated shield case having an open side;

a corona discharging wire fixedly positioned to extend longitudinally within said shield case, such that electrostatic charge from said wire is directed through said open side of said shield case;

means for adjusting the width of electrostatic charge directed from said open side of said shield case, said adjusting means comprising a shield cover formed of an electrically insulative material, and means for revovably mounting said shield cover, at a selected position of a plurality of longitudinally adjustably spaced positions, on one longitudinal end of said shield case, such that said shield cover extends over a respective portion of said open side and covers a corresponding portion of the length of said wire;

said shield case having, on a side thereof opposite said open side, a longitudinal rail member;

a longitudinal rail receiving member having a configuration complementary to the configuration of said rail member, said rail member being mounted for longitudinal sliding movement within said rail receiving member;

means for mounting said rail receiving member on a fixed wall of an electrostatic photographic copying machine such that said open side of said shield case is directed toward the periphery of a photsensitive drum of the copying machine and such that the longitudinal dimension of said shield case extends substantially parallel to the axis of the drum, said rail receiving member mounting means including means for selectively adjusting the position of said rail receiving member, and thereby of said shield case and said wire, in directions radially of the drum; and handle means connected to said shield case to enable said shield case to be selectively moved longitudinally with respect to said rail receiving member.

2. An apparatus as claimed in claim 1, wherein said shield case has a generally U-shaped configuration with a pair of spaced side walls defining said open side, and further comprising a pair of bases fixed to said shield case at opposite longitudinal ends thereof, opposite ends of said wire being fixed to said bases, and said wire extending between said side walls.

3. An apparatus as claimed in claim 2, wherein said shield cover mounting means comprises pairs of longitudinally spaced openings formed in said sise walls at said one end of said shield case, and a pair of projections extending from opposite sides of said shield cover and fittable into a selected pair of openings in said side walls.

4. An apparatus as claimed in claim 3, wherein said shield over has a generally U-shaped configuration including side walls fitting within said side walls of said shield case.

5. An apparatus as claimed in claim 3, wherein said shield cover comprises a flat plate.

6. An apparatus as claimed in claim 2, wherein said shield cover mounting means comprises pairs of longitudinally spaced openings formed in said shield cover, and a pair of projections extending from said side walls at said one end of said shield case and fittable into a selected pair of openings in said shield cover.

7. An apparatus as claimed in claim 6, wherein said shield cover has a generally U-shaped configuration including side walls having therein said plurality of openings and fitting over said side walls of said shield case, said projections extending outwardly from said side walls of said shield case and fitting into selected said openings in said side walls of said shield cover.

8. An apparatus as claimed in claim 6, wherein said shield cover has a generally U-shaped configuration including side walls having therein said plurality of openings and fitting within said side walls of said shield case, said projections extending inwardly from said side walls of said shield case and fitting into selected said openings in said side walls of said shield cover.

9. An apparatus as claimed in claim 1, wherein said rail receiving member mounting means comprises a channel member adapted to be mounted on the fixed wall of the copying machine, said channel member having extending from opposite ends thereof brackets for supporting respective ends of said rail receiving member, said adjusting means comprising, at at least first adjacent ends of said channel member and said rail receiving member, a bracket extending from said rail receiving member and positioned adjacent said bracket at said first end of said channel member, a hole in said bracket at said first end of said channel member, said hole being elongated radially of the drum, and bolt means extending through said elongated hole and through a hole in said bracket of said rail receiving member for clamping said brackets together at selected relative positions therebetween limited by said elongated hole.

10. An apparatus as claimed in claim 9, wherein said bracket at a second end of said channel member has therein a hole, and an adjacent second end of said rail receiving member has a projection fitting into said hole.

11. An apparatus as claimed in claim 1, wherein said rail receiving member mounting means comprises a channel member adapted to be mounted on the fixed wall of the copying machine, said channel member having extending from opposite ends thereof brackets for supporting respective ends of said rail receiving member, said adjusting means comprising, at at least first adjacent ends of said channel member and said rail receiving member, a bracket extending from said rail receiving member and facing said bracket at said first end of said channel member, a spring positioned between and urging said adjacent brackets apart, and bolt means extending radially of the drum and through said adjacent brackets for adjusting the relative spacing between said adjacent brackets.

12. An apparatus as claimed in claim 11, wherein said bracket at a second end of said channel member has therein a hole, and an adjacent second end of said rail receiving member has a projection fitting into said hole.

13. An apparatus as claimed in claim 1, further comprising spring means positioned between said rail member and said rail receiving member for urging such members into frictional engagement.

* * * * *